US008561537B2

(12) United States Patent
Fejfar et al.

(10) Patent No.: US 8,561,537 B2
(45) Date of Patent: Oct. 22, 2013

(54) APPARATUS FOR THE AUTOMATIC DETERMINATION OF PRESETTING VALUES FOR INKING ZONE SETTING ELEMENTS OF AN INKING UNIT OF A PRESS

(75) Inventors: Florian Fejfar, München (DE); Andreas Metzner, Aystetten (DE)

(73) Assignee: manroland AG, Offenbach (DE)

( * ) Notice: Subject to any disclaimer, the term of this patent is extended or adjusted under 35 U.S.C. 154(b) by 2124 days.

(21) Appl. No.: 11/412,584

(22) Filed: Apr. 27, 2006

(65) Prior Publication Data

US 2006/0243149 A1 Nov. 2, 2006

(30) Foreign Application Priority Data

Apr. 28, 2005 (DE) ..... 10 2005 019 777

(51) Int. Cl.
*B41F 31/02* (2006.01)

(52) U.S. Cl.
USPC ..... 101/365

(58) Field of Classification Search
None
See application file for complete search history.

(56) References Cited

U.S. PATENT DOCUMENTS

| | | | | |
|---|---|---|---|---|
| 4,573,798 | A | 3/1986 | Fujie et al. | |
| 5,058,500 | A | 10/1991 | Mizuno | |
| 5,724,143 | A | 3/1998 | Huber et al. | |
| 2001/0002577 | A1 * | 6/2001 | Mayer et al. | 101/365 |
| 2003/0213388 | A1 * | 11/2003 | Mayer et al. | 101/365 |

FOREIGN PATENT DOCUMENTS

| | | |
|---|---|---|
| DE | 36 21 094 | 3/1987 |
| GB | 22 98 985 | 9/1996 |

OTHER PUBLICATIONS

Search Report dated Apr. 28, 2005 issued for the corresponding German Application No. 10 2005 019 777.9.

* cited by examiner

*Primary Examiner* — Jill Culler
(74) *Attorney, Agent, or Firm* — Cozen O'Connor

(57) ABSTRACT

At least one mark is integrated into an image data set from a prepress stage, and the mark is scanned in order to automatically determine a region or an extract of the image data set which is relevant to the determination of zonal area coverage values. Zonal area coverage values for a print are determined from the region or extract, and presetting values for the inking zone setting elements are determined from the zonal area coverage values.

7 Claims, 1 Drawing Sheet

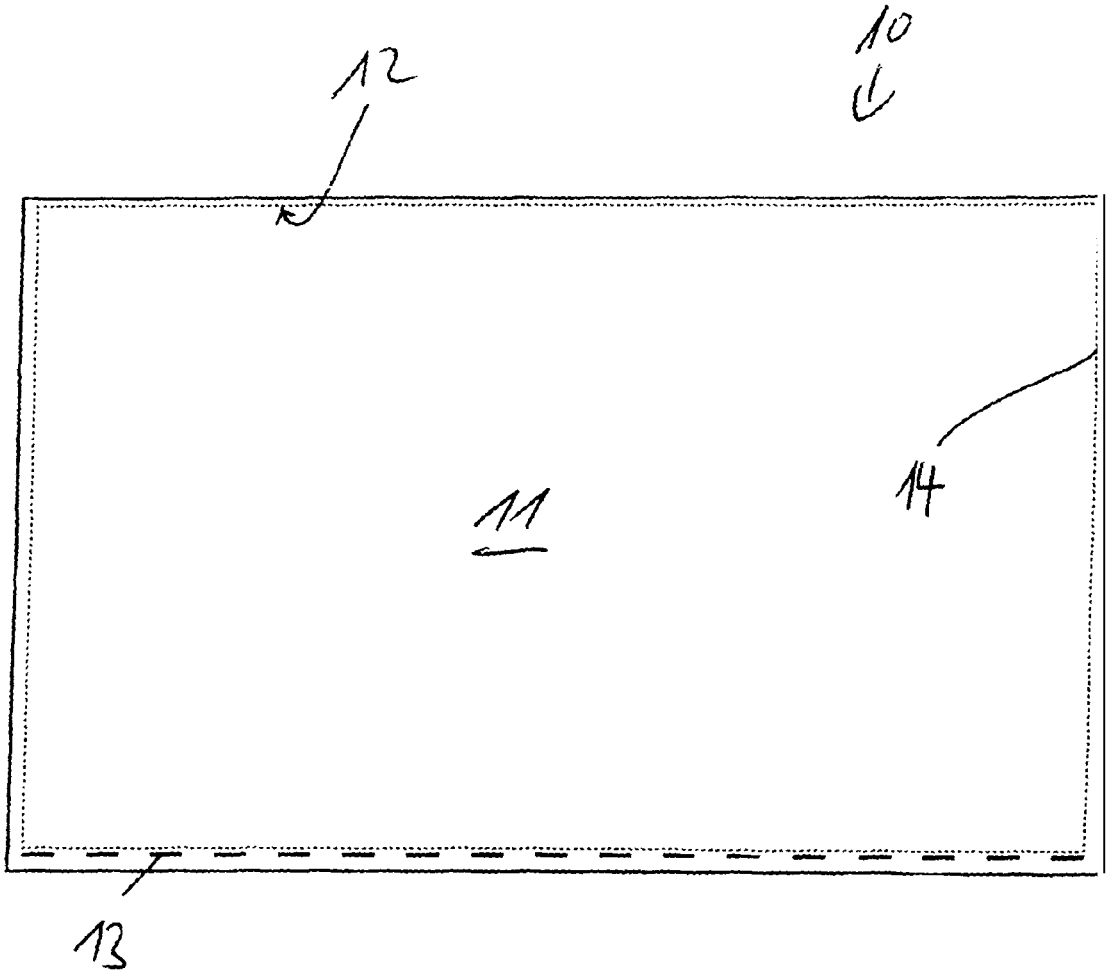
10
12
14
11
13

APPARATUS FOR THE AUTOMATIC DETERMINATION OF PRESETTING VALUES FOR INKING ZONE SETTING ELEMENTS OF AN INKING UNIT OF A PRESS

BACKGROUND OF THE INVENTION

1. Field of the Invention

The invention relates to a method and an apparatus for the automatic determination of presetting values for the opening positions of inking zone setting elements, in particular ink blades of ink slides, of an inking unit of a press.

2. Description of the Related Art

During printing, a printing material is moved successively through a plurality of printing units of a press, as a rule a printing ink being applied to the printing material in each printing unit. During autotypical overprinting, as a rule the four scale colors black, magenta, cyan and yellow and, if necessary, special colors are printed, there being a separate printing unit and therefore inking unit for each of these printing inks. The inking unit of each printing unit has an ink metering device, the ink metering device having a number of inking zone setting elements corresponding to the number of inking zones. The inking zone setting elements are also designated ink slides or ink blades. Depending on the opening position of the inking zone setting elements, printing ink is applied to an ink fountain roll, which is also designated a ductor roll. The quantity of ink reaching the ductor roll per inking zone as a function of the inking zone setting elements is transferred by a distributor roll or film roll to an inking unit roll arranged downstream of the latter and is moved by further inking unit rolls in the direction of a forme cylinder or plate cylinder of the respective printing unit. What is known as a transfer cylinder or rubber-covered cylinder interacts with the forme cylinder and transfers the printing ink from the forme cylinder to the printing material.

The color configuration of a printed product to be printed, what is known as the subject, is defined in a prepress stage in the form of image data. Here, what are known as area coverage values are defined for all colors to be printed and therefore for all the inking units involved in the print. For each individual image point of each inking zone of an inking unit involved in the print, an area coverage value is predetermined, an average or zonal area coverage value of the respective inking zone resulting from the area coverage values of the individual image points of an inking zone. One particular difficulty which arises during printing then resides on presetting the inking zone setting elements of the inking units involved in the printing from the image data from the prepress stage in such a way that as far as possible the first printed product printed with this presetting comes as close as possible to the original from the prepress stage.

According to the prior art, when determining presetting values for the inking zone setting elements, the procedure is such that zonal area coverage values for the inking zones involved in the print are determined from an image data set from a prepress stage, and in that, furthermore, the presetting values for the inking zone setting elements are determined from these zonal area coverage values. The image data set from the prepress stage is in this case normally available in the PPF format or else in the JDF format, it being possible for the zonal area coverage values according to the prior art to be calculated from such image data sets. However, the problem here is that the image data set provided from the prepress stage does not represent or depict the printing region exactly. Instead, the region covered by the image data set is normally larger than the region actually printing, since the image data set also depicts measurement control strips, for example, beside the actual printing region. In addition, the image data from the image data set from the prepress stage can be rotated and/or mirrored or inverted. Apparatus known from the prior art for determining presetting values for the inking zone setting elements have setting possibilities in order, for example, to mask out regions of the image data set outside the actual printing region, or to take into account the rotation and/or the mirroring of the image data of the image data set.

In this case, however, the determination of the actual printing region from the image data set from the prepress stage, and also the determination of the mirroring and/or rotation of the same, presents considerable difficulties, so that, according to the prior art, as a rule erroneous settings are made, on the basis of which incorrect zonal area coverage values and therefore ultimately incorrect presetting values for the inking zone setting elements are determined. Too much or too little printing ink is then supplied to the inking zones of inking unit, which necessarily leads to undesired color shifts and lightness shifts in the print and, as a result, to rejects. This is disadvantageous for cost reasons.

SUMMARY OF THE INVENTION

Taking this as a starting point, the present invention is based on the problem of providing a novel method and a corresponding apparatus for the automatic determination of presetting values for inking zone setting elements of an inking unit of a press.

According to the invention, at least one mark is integrated into the image data set from the prepress stage used for the determination of the zonal area coverage values; by scanning the or each mark, the region or extract from the image data set from the prepress stage which comprises the image data relevant to the determination of the zonal area coverage value is determined automatically. The zonal area coverage values are determined exclusively from the image data of this region of the image data set determined by scanning the or each mark.

In the spirit of the present invention, at least one mark is integrated into the image data set from the prepress stage which is used for the determination of the zonal area coverage values. The or each mark is scanned and, on the basis of this scanning, the region or extract from the image data set from the prepress stage which includes the image data relevant to the determination of the zonal area coverage is determined automatically. In this way, during the determination of the zonal area coverage values, it is possible to ensure that access is made only to the image data of the image data set from the prepress stage which represent or depict the printing region exactly.

According to an advantageous development of the invention, when scanning the or each mark, the position, in particular the rotation and/or mirroring, of the region having the image data relevant to the determination of the zonal area coverage values is determined automatically. The zonal area coverage values are then determined while taking account of the position of the region having the relevant image data, so that errors during the determination of the presetting values for the inking zone elements, which are caused by the rotation and/or mirroring of the image data set, can automatically be avoided.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The sole FIGURE of a schematic illustration of a subject of a printed page with a mark in order to illustrate the method according to the invention.

DETAILED DESCRIPTION OF THE PRESENTLY PREFERRED EMBODIMENTS

The invention relates to a method and apparatus for the automatic determination of presetting values for the opening positions of inking zone setting elements of an inking unit of a press, the inking zone setting elements normally being designated ink blades or ink slides. The presetting values are determined from an image data set from a prepress stage by first determing zonal area coverage values for the inking zones involved in the print from the image data set from the prepress stage. The presetting values for the respective inking zone setting elements are subsequently determined from these zonal area coverage values for the inking zones involved in the print.

In the spirit of the present invention, at least one mark is integrated into the image data set from the prepress stage used for the determination of the zonal area coverage values. By scanning the or each mark, the region or extract from the image data set from the prepress stage which includes the image data relevant to the determination of the zonal area coverage is determined automatically. The zonal area coverage values are determined exclusively from the image data of this region or extract of the image data set from the prepress stage determined by scanning the or each mark. This ensures that the area coverage values are determined only on the basis of the image data of the image data set from the prepress stage which represent or depict the printing region of the image data set exactly. Regions or extracts of the image data set that do not belong to the printing region can be masked out in this way. During the scanning of the or each mark, the position, specifically the rotation and, if appropriate, the mirroring of the region having the image data relevant to the determination of the zonal area coverage values are determined automatically. The zonal area coverage values are then additionally determined while taking account of the position of the region comprising the relevant image data, determined during the scanning of the or each mark. In this way, rotation and, if appropriate, mirroring of the region comprising the relevant image data can also be taken into account automatically during the determination of the presetting values for the inking zone setting elements.

The FIGURE shows in highly schematic form a subject of a printed page 10, defined via an image data set from a prepress stage, the image data set, in addition to the image data from the actual printing region 11 outlined by the dashed line 12, also including image data from a non-printing region, which surrounds the actual printing region 11 with the effect of a frame. Print control elements, not illustrated, may be positioned in the non-printing region. Furthermore, the FIGURE shows a mark integrated into the subject and the image data set from the prepress stage, which is formed from a sequence of horizontally arranged bars 13 alternately colored black and white and also a sequence of vertically arranged bars 14, likewise alternately colored black and white. In this case, the width of the bars 13 running horizontally corresponds to the inking zones of the inking unit; the bars 14 running vertically have a shorter length as compared with the bars 13 running horizontally. By means of scanning the mark formed by the bars 13 and 14, in addition to the region 11 relevant to the determination of the zonal area coverage values, the position, specifically the rotation and, if appropriate, mirroring of the region 11, can be determined automatically. The mark formed by the bars 13 and 14 merely has a purely exemplary nature and can also be designed in another way.

The mark is preferably integrated into the image data set from the prepress stage used for the determination of the zonal area coverage values in such a way that the mark or a constituent part of same appears in the image data of each color separation of all the printing inks involved in the print. In this way, it is possible to ensure that, for all the printing inks and therefore for all the inking units involved in the print, appropriate presetting values can be determined for the inking zone setting elements. In addition to the rotation and, if appropriate, mirroring of the region having the image data relevant to the determination of the zonal area coverage values, it is also possible for what is known as a positive output or negative output of this region to be determined by scanning the or each mark and to be taken into account during the calculation of the presetting values for the inking zone setting elements.

Parameters or data determined during the scanning of the or each mark and relating to the region of the image data set from the prepress stage including the image data relevant to the determination of the zonal area coverage values can be stored and/or displayed and/or printed out in the spirit of the present invention. On the basis of these parameters or data, as already mentioned, the determination of the zonal area coverage values from the image data set from the prepress stage, and therefore ultimately the determination of the presetting values for the inking zone setting elements is carried out. An apparatus according to the invention includes appropriate means for carrying out the method according to the invention.

With the aid of the invention, the determination of presetting values for the inking zone setting elements of an inking unit of a press can be improved considerably. The zonal area coverage values needed for the determination of the presetting values are in this case determined only on the basis of the image data of the image data set from the prepress stage which depict the printing region exactly. Erroneous settings of the inking zone setting elements can be avoided in this way, so that fewer rejects are printed. This results in cost advantages.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for the automatic determination of presetting values for the opening positions of inking zone setting elements of an inking unit of a printing press, the method comprising:

providing an image data set from a prepress stage, at least one mark being integrated into the image data set;

determining a region or an extract of the image data set automatically by scanning said at least one mark, said region or extract comprising image data relevant to the determination of zonal area coverage values;

determining zonal area coverage values for a print exclusively from the image data of said region or said extract of said image data set; and determining the presetting values for the inking zone setting elements from the zonal area coverage values.

2. The method of claim 1 wherein the zonal area coverage values are determined exclusively from said region.

3. The method of claim 1 wherein the position of said region is determined automatically by said scanning.

4. The method of claim 3 wherein the zonal area coverage values are determined taking the position into account.

5. The method of claim 3 wherein said position comprises at least one of rotation and mirroring.

6. The method of claim 1 wherein said at least one mark is integrated into the image data set in such a way that at least a constituent part of said at least one mark appears in the image data of each color separation of all the printing inks involved in the print.

7. Apparatus for the automatic determination of presetting values for the opening positions of inking zone setting elements of an inking unit of a printing press, the apparatus comprising:

means for scanning at least one mark integrated into an image data set from a prepress stage;

means for determining a region or an extract of the image data set automatically on the basis of said scanning;

means for determining zonal area coverage values for a print from said region or said extract; and means for determining presetting values for the inking zone setting elements from the zonal area coverage values.

* * * * *